US008297873B1

(12) United States Patent
Schram et al.

(10) Patent No.: US 8,297,873 B1
(45) Date of Patent: Oct. 30, 2012

(54) LOCKING GROUND POST

(75) Inventors: Michael D. Schram, Geneva, IL (US); Jon M. Schram, Geneva, IL (US)

(73) Assignee: Schram Management Company, Geneva, IL (US)

( * ) Notice: Subject to any disclaimer, the term of this patent is extended or adjusted under 35 U.S.C. 154(b) by 0 days.

(21) Appl. No.: 13/409,826

(22) Filed: Mar. 1, 2012

(51) Int. Cl.
*E01F 9/013* (2006.01)

(52) U.S. Cl. ..... 404/9; 40/607.01; 40/607.04; 40/607.1

(58) Field of Classification Search ..... 40/607.01, 40/607.02, 607.04, 607.05, 607.1, 610, 612; 404/6, 9; 116/63 R
See application file for complete search history.

(56) References Cited

U.S. PATENT DOCUMENTS

| | | | | |
|---|---|---|---|---|
| 1,033,187 | A | 7/1912 | Metzger | |
| 2,698,761 | A | 1/1955 | Claypool et al. | |
| 2,719,688 | A | 10/1955 | Seifert | |
| 3,049,728 | A | 8/1962 | Lund | |
| 3,061,960 | A | 11/1962 | Dull | |
| 3,102,725 | A | 9/1963 | Jarus | |
| 3,119,588 | A | 1/1964 | Keats | |
| 3,417,508 | A | 12/1968 | Sprung | |
| 3,600,853 | A | 8/1971 | Goldberg | |
| 3,956,853 | A | 5/1976 | Montgomery | |
| 4,003,161 | A | 1/1977 | Collins | |
| 4,561,798 | A | 12/1985 | Elcrin et al. | |
| 4,576,508 | A * | 3/1986 | Dickinson | 404/6 |
| 4,611,662 | A | 9/1986 | Harrington | |
| 4,666,331 | A * | 5/1987 | Riley | 404/6 |
| 4,746,149 | A | 5/1988 | Thompson | |
| 5,018,902 | A | 5/1991 | Miller et al. | |
| 5,186,197 | A | 2/1993 | Lavine | |
| 5,192,159 | A | 3/1993 | Higginson | |
| 5,253,716 | A | 10/1993 | Mitchell | |
| 5,287,869 | A | 2/1994 | Wu | |
| 5,441,359 | A | 8/1995 | Filippi | |
| 5,466,020 | A | 11/1995 | Page et al. | |
| 5,474,017 | A * | 12/1995 | Mohebbi et al. | 116/209 |
| 5,481,828 | A * | 1/1996 | Kentrotas | 49/35 |

(Continued)

FOREIGN PATENT DOCUMENTS

AU 624290 6/1992

(Continued)

OTHER PUBLICATIONS

International Search Report and Written Opinion dated Jun. 18, 2009 for PCT Patent Application No. PCT/US2009/040743, 10 pgs.

*Primary Examiner* — Gary S Hartmann
(74) *Attorney, Agent, or Firm* — Edwards Wildman Palmer LLP

(57) ABSTRACT

A bollard assembly having a post and a sleeve. The post has a cylindrical post wall forming a cavity, an insert included with in the cavity and a longitudinal passage in the post wall. The insert has a helical wedge at its lower end with a gap in the wedge. The sleeve has a cylindrical sleeve wall forming a cavity and a latch pin that is attached to the sleeve wall and extends into the cavity. The sleeve is adapted to receive the post such that the latch pin travels through the passage in the post wall and the gap in the wedge of the insert wherein the insert can then be rotated such that the latch pin and gap are no longer aligned and the latch pin prevents upward movement of the insert and post.

18 Claims, 8 Drawing Sheets

U.S. PATENT DOCUMENTS

| | | | | |
|---|---|---|---|---|
| 5,487,618 | A | 1/1996 | Cox | |
| 5,502,910 | A | 4/1996 | Lucchesi | |
| 5,597,262 | A | 1/1997 | Beavers et al. | |
| 5,625,988 | A | 5/1997 | Killick | |
| 5,738,592 | A | 4/1998 | Saunders | |
| 5,741,084 | A | 4/1998 | Del Rio et al. | |
| 5,895,169 | A | 4/1999 | Holm et al. | |
| 5,961,249 | A * | 10/1999 | Hansen et al. | 404/9 |
| 6,065,900 | A | 5/2000 | Reale | |
| 6,155,744 | A | 12/2000 | Nammany | |
| 6,398,136 | B1 | 6/2002 | Smith | |
| 6,409,419 | B1 * | 6/2002 | Hernandez | 404/6 |
| 6,435,760 | B1 | 8/2002 | Pettesch | |
| 6,494,636 | B1 * | 12/2002 | Mozena | 403/109.2 |
| 6,539,759 | B2 | 4/2003 | Pershall | |
| 6,719,484 | B1 | 4/2004 | Johnson | |
| 6,805,515 | B2 | 10/2004 | Reale | |
| 6,821,050 | B1 * | 11/2004 | Maldonado | 404/6 |
| 6,830,518 | B2 | 12/2004 | Graskewicz | |
| 7,472,891 | B2 | 1/2009 | Schram et al. | |
| 7,481,599 | B2 * | 1/2009 | Stice | 404/6 |
| 7,524,135 | B1 | 4/2009 | Mirman et al. | |
| 7,614,819 | B1 | 11/2009 | Mirman et al. | |
| 7,722,285 | B2 | 5/2010 | Schram et al. | |
| 2006/0204327 | A1 | 9/2006 | Phelan | |

FOREIGN PATENT DOCUMENTS

| | | | |
|---|---|---|---|
| DE | 2513275 | A1 | 10/1976 |
| EP | 0369860 | A2 | 5/1990 |
| FR | 2432598 | A3 | 2/1980 |
| FR | 2686355 | A1 | 7/1993 |
| GB | 2281927 | A | 3/1995 |
| GB | 2297781 | A | 4/1997 |
| GB | 2306185 | A | 4/1997 |
| GB | 2346640 | A | 8/2000 |
| GB | 2346642 | A | 8/2000 |
| GB | 2392699 | A | 3/2004 |

* cited by examiner

LOCKING GROUND POST

FIELD OF THE INVENTION

This invention relates generally to bollards. In particular, this invention relates to removable and lockable bollards.

BRIEF SUMMARY

In one example, a bollard assembly having a post and a sleeve is provided. The post has a cylindrical post wall forming a cavity and a passage in the post wall. A plate extends across the cavity of the post at one end. A locking insert comprising a pipe is positioned axially within the cavity of the post. The locking insert has a generally penannular wedge member extending radially outward from the pipe and has a first and second end defining a gap therebetween. The locking insert is rotatable within the cavity of the post such that rotation of the locking insert will align and misalign the gap of the wedge member with the passage in the post wall. The sleeve has a cylindrical sleeve wall forming a cavity and a latch pin that is attached to the sleeve wall and extends into the cavity. The sleeve is adapted to receive the post such that the latch pin travels through the passage in the post wall and the gap in the wedge member of the locking insert when the passage in the post wall and the gap in the wedge member are aligned. The locking insert can then be rotated to misalign the gap in the wedge and the latch pin such that the latch pin prevents upward movement of the locking insert and post.

In another example, the bollard assembly also has a sleeve cover that is interchangeable with the post. The sleeve cover has a generally cylindrical cover wall forming a cavity and a passage in the cover wall. A plate extends across the cavity at one end of the sleeve cover. A cover locking insert comprising a pipe is positioned axially within the cavity of the sleeve cover. The cover locking insert has a generally penannular wedge member extending radially outward from the pipe and has a first and second end defining a gap therebetween. The cover locking insert is rotatable within the cavity of the sleeve cover such that rotation of the cover locking insert will align and misalign the gap of the wedge member of the cover locking insert with the passage in the cover wall. The sleeve is adapted to receive the sleeve cover in the same manner as the post such that the latch pin travels through the passage in the cover wall and the gap in the wedge member of the cover locking insert when the passage in the cover wall and the gap in the wedge member of the cover locking insert are aligned. The cover locking insert can then be rotated to misalign the gap in the wedge of the cover locking insert and the latch pin such that the latch pin prevents upward movement of the cover locking insert and sleeve cover.

DETAILED DESCRIPTION

Figure 1:
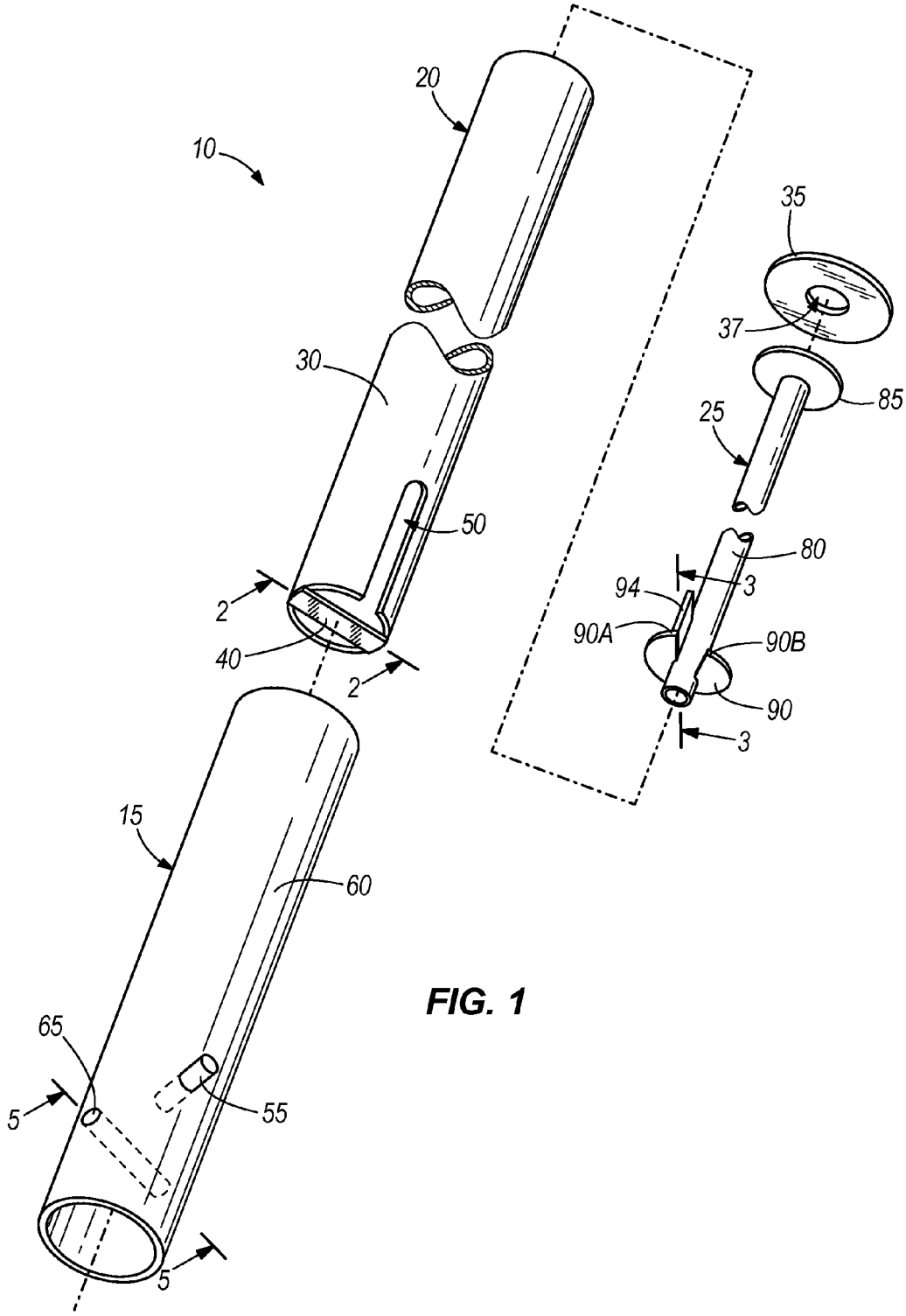
FIG. 1 is a perspective view of one example of a bollard assembly.

Referring to FIG. 1, an exemplary bollard assembly 10 has a ground sleeve 15, a post 20, and an insert 25. The post 20 has a wall 30, an end cap 35, and a stop plate 40. The wall 30 in this example is generally cylindrical and forms cavity 45 and is dimensioned to receive the insert 25 into the cavity 45. A passage 50 is formed in the wall 30 and is adapted to receive a latch pin 55 of ground sleeve 15. In one example, the post wall 30 is hot dipped galvanized steel. However, the wall 30 can be made of other appropriate material, such as carbon steel, stainless steel, or High Density Polyethylene (HDPE), as desired for any particular application. In addition, the wall 30 of post 20 can have an outer diameter of 3.5, 4.5, or 6.625 inches, or any other outer diameter that is appropriate for a particular application and compatible with a corresponding ground sleeve.

Figure 2:
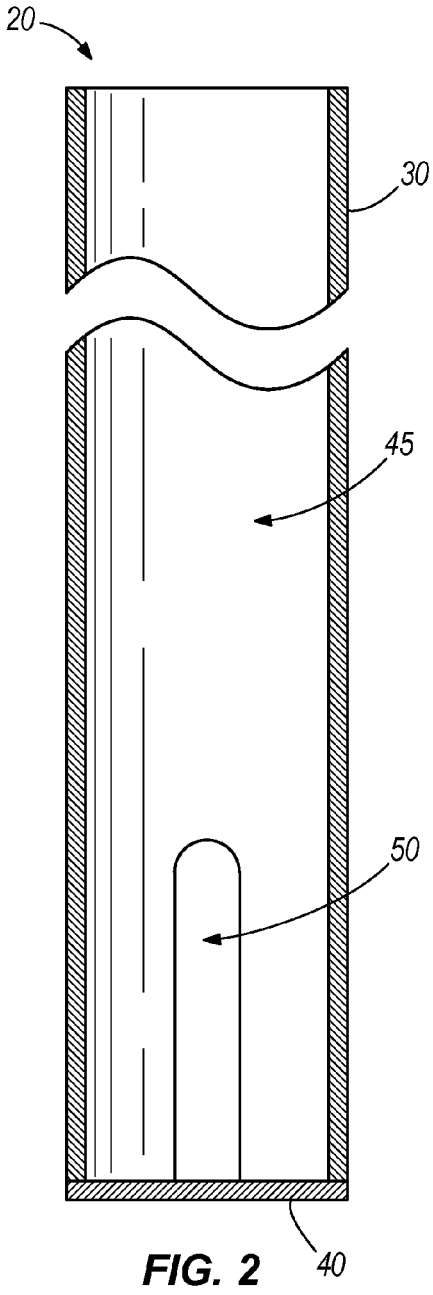
FIG. 2 is a cross-sectional view of a post of the bollard assembly of FIG. 1 taken across line 2-2 in FIG. 1.

In the example shown and with particular reference to FIGS. 1 and 2, the passage 50 begins at one end of the wall 30 and extends longitudinally along the wall 30. In other examples, the passage 50 may have a different configuration such as, for example, multiple intersecting sections that are configured non-linearly with respect to each other.

Figure 8:
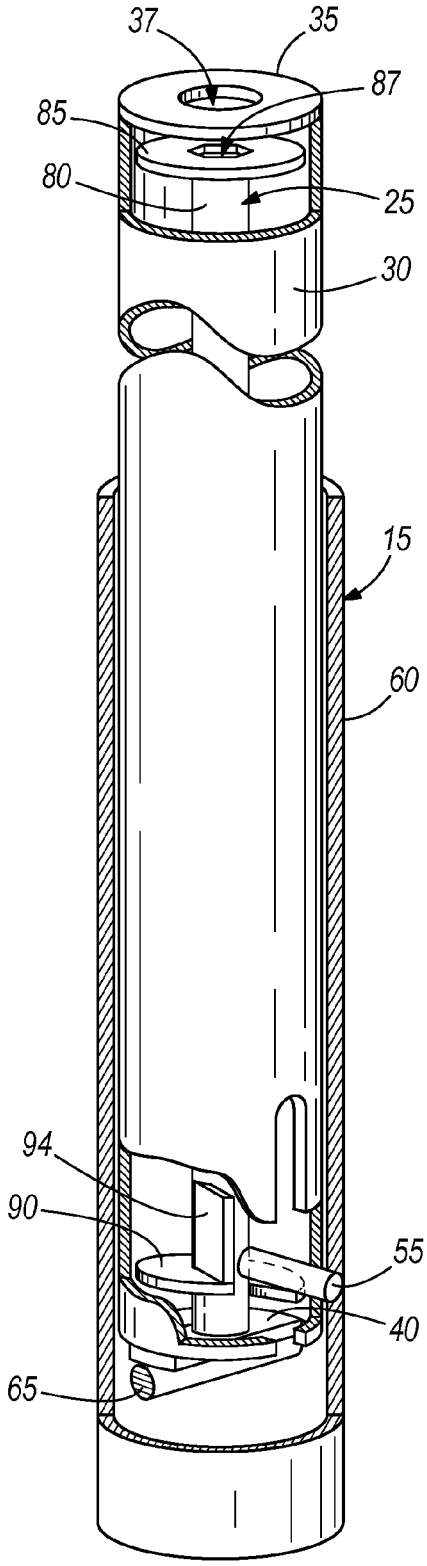
FIG. 8 is a cutaway perspective view of the assembled bollard assembly of FIG. 1 in an unlocked position.
Figure 9:
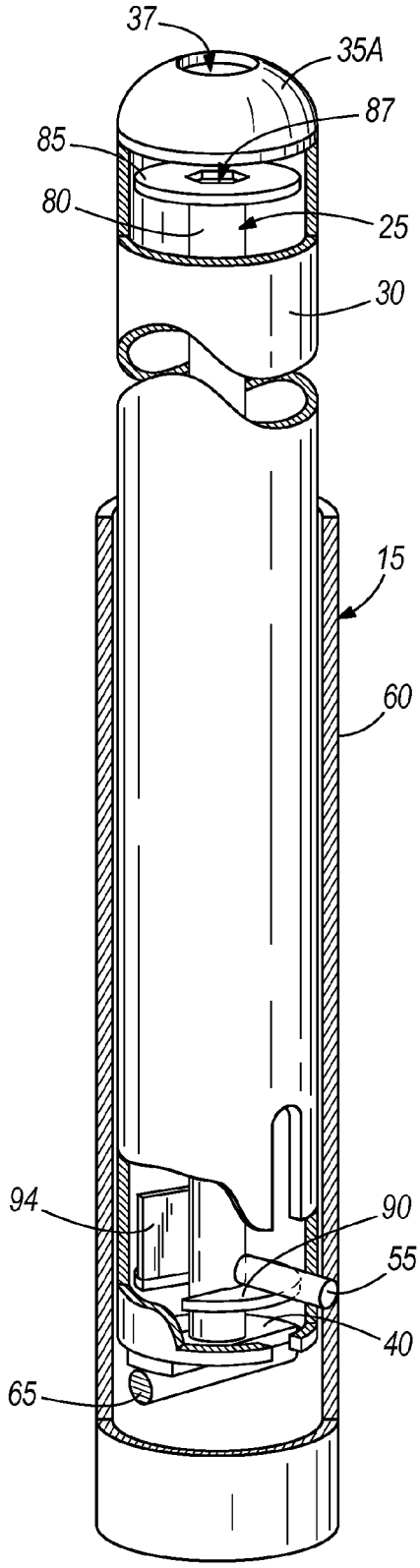
FIG. 9 is a cutaway perspective view of the assembled bollard assembly of FIG. 1 in a locked position, with an alternate end cap.

The end cap 35 covers the end of the wall 30 opposite the passage 50, as seen in FIGS. 8 and 9. In one example, the end cap 35 is a generally circular plate with flat top and bottom surfaces that has roughly the same outer diameter as the wall 30, as shown in FIG. 8. Alternatively, as shown in FIG. 9, end cap 35A may be hemispherical with a domed top surface. The end cap 35 includes a hole 37 through its center that is dimensioned to allow a tool, such as a T-handle Allen Wrench, to pass therethrough and engage the insert 25 within the cavity 45. The end cap 35 is secured to the wall 30 by any well known means, such as welding, as is appropriate for the particular material used. Alternatively, the end cap 35 can be integrally formed as part of the wall 30. The end cap 35 is typically manufactured of the same material as the post wall 30.

The stop plate 40 is positioned at the base of the wall 30, and extends across cavity 45 such that the ends of the stop plate 40 are generally flush with the outer surface of the wall 30 and can be secured to the wall 30 by any well known means, such as welding, as is appropriate for the particular material used. The stop plate 40 prevents the insert 25 from traveling too far into the post 20 as well as prevent the post 20 from being removed from the ground sleeve 15 once the insert 25 is locked into place. The stop plate 40 is typically manufactured of the same material as the post wall 30.

Figure 5:
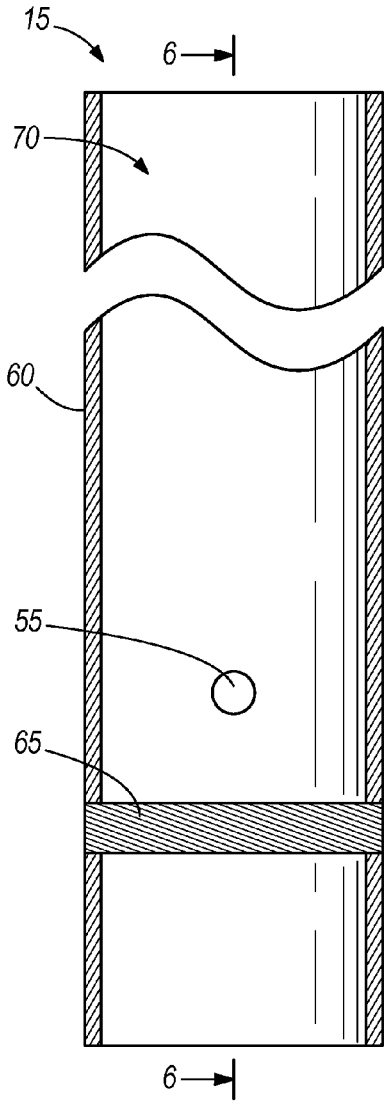
FIG. 5 is a cross-sectional view of a ground sleeve of the bollard assembly of FIG. 1 taken across line 5-5 in FIG. 1.
Figure 6:
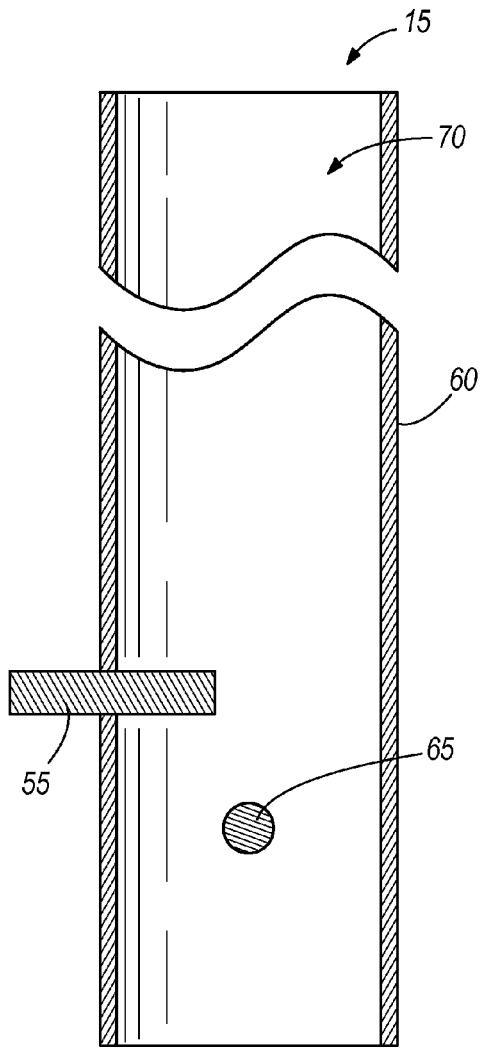
FIG. 6 is a cross-sectional view of the ground sleeve of the bollard assembly of FIG. 1 taken across line 6-6 in FIG. 5.
Figure 7:
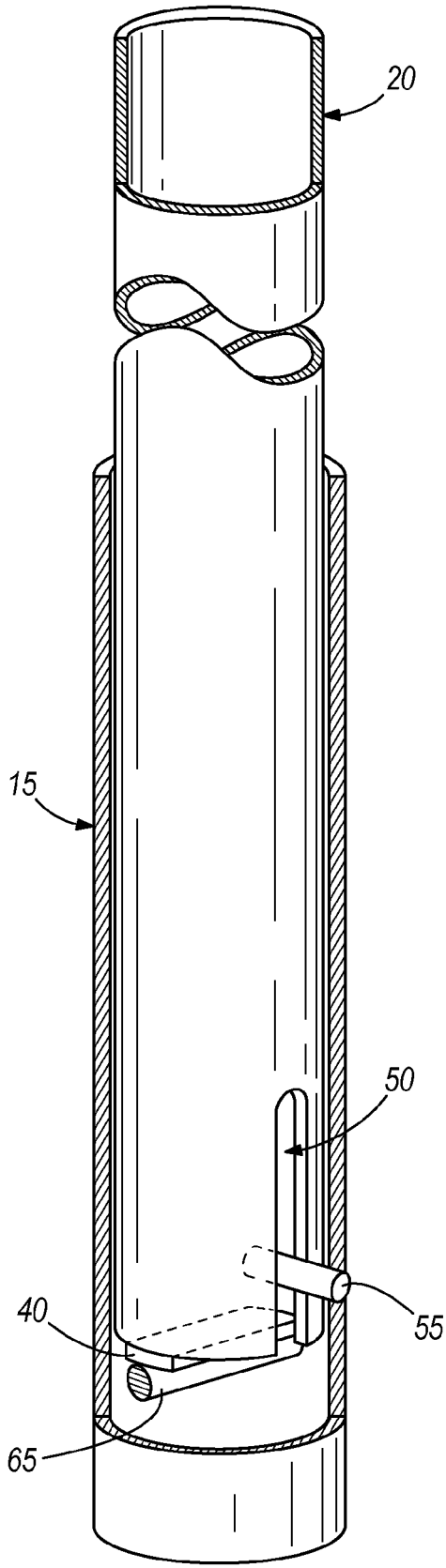
FIG. 7 is a cutaway perspective view of an assembled ground sleeve and post of the bollard assembly of FIG. 1.

Referring to FIGS. 1, 5 and 6, the ground sleeve 15 has a wall 60, a latch pin 55, and a stop bar 65. The wall 60 is generally cylindrical, forms cavity 70, and is dimensioned to receive the post 20 into the cavity 70. In one example, the ground sleeve wall 60 is hot dipped galvanized, but could be made of any desired material as is appropriate for a particular application. The ground sleeve wall 60 typically a length of 12 inches after galvanizing and can have an outer diameter of 4.25 inches/inner diameter of 3.5625 inches, an outer diameter of 5.25 inches/inner diameter of 4.625 inches, or an outer diameter of 7.25 inches/inner diameter of 6.875 inches, or any other outer/inner diameter desired as is appropriate for a particular application and properly engages the corresponding post 20. In addition, in this example, the latch pin 55 is a 0.625 inch diameter bar of 1018 steel, has a length of 2.75 inches, and is positioned such that 2 inches of the latch pin 55 extends outside of the wall 60 and the stop bar 65 is a 0.625 inch diameter bar of 1018 steel, has a length of 4 inches, and is positioned such that the ends of the stop bar 65 are generally flush with the outer surface of the wall 60.

The latch pin 55 is positioned through a hole in the wall 60 and is welded in place. The latch pin 55 is positioned such that one end extends into the cavity 70 and the opposite end extends from the outside surface of the wall 60. The portion of the latch pin 55 that extends into the cavity 70 is positioned such that it will travel through the passage 50 in the post 20 when the post is inserted into the ground sleeve 15. The portion of the latch pin 55 that extends outside of the wall 60 prevents movement of the ground sleeve 15 when the ground sleeve 15 is installed in the ground. Alternatively, the latch pin 55 could also be positioned such that one end extends into the cavity 70 and the opposite end is generally flush with the outer surface of the wall 60.

The stop bar 65 is positioned through a set of holes in the wall 60, which are aligned on opposite sides of the wall 60, such that the stop bar 65 extends across cavity 70 and is positioned such that the ends of the stop bar 65 are generally flush with the outer surface of the wall 60 and is welded in place. The stop bar 65 will prevent the post 20 from traveling too far into the ground sleeve 15. Alternatively, the stop bar 65 could be positioned through a single hole in wall 60 and extend into cavity 70, much like the latch pin 55. Alternatively, the stop bar 65 could have a length that is greater than the outer diameter of the wall 60, thereby extending across cavity 70 and outside the outer surface of the wall 60, to prevent movements of the ground sleeve 15 when the ground sleeve 15 is installed in the ground.

Figure 3:
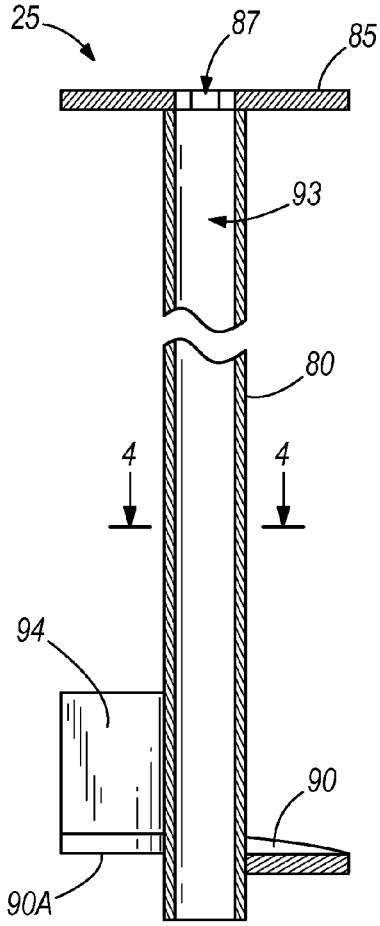
FIG. 3 is a cross-sectional view of a locking insert of the bollard assembly of FIG. 1 taken across line 3-3 in FIG. 1.
Figure 4:
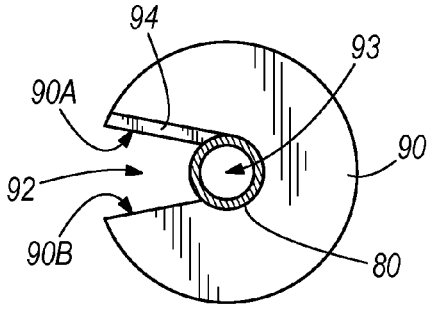
FIG. 4. is a cross-sectional view of the locking insert of FIG. 3 taken across line 4-4 in FIG. 3.

Referring to FIGS. 1 and 3, the insert 25 includes a pipe 80, an end plate 85 and a wedge 90. The pipe 80 is generally cylindrical and hollow, forming a cavity 93 through the length of the pipe 80 such that liquids can travel in one end of the pipe 80, through the cavity 93, and out the other end of the pipe 80. In one example, the pipe 80, end plate 85 and wedge 90 are hot dipped galvanized steel. However, the pipe 80, end plate 85 and wedge 90 can be made of any other appropriate materials, such as carbon steel, or stainless steel.

The end plate 85 is a generally circular plate secured to one end of the pipe 80, and has an outer diameter that is less than the inner diameter of the wall 30 of post 20, such that the pipe 80 and end plate 85 fit snuggly within the cavity 45 of the post 20. The end plate 85 may be secured to the pipe 80 by any well known means, such as welding, or the end plate 85 can be integrally formed as part of the pipe 80. The end plate 85 includes a hole 87 through its center that is shaped and dimensioned to engage a tool to allow the insert 25 to be rotated via the tool. In the example shown, hole 87 is a hexagon and is shaped and dimensioned to engage a T-handle Allen Wrench.

The wedge 90 has a split C-shape and is positioned helically around the outer surface of the pipe 80 a predetermined distance from the end of the pipe opposite the end plate 85. Alternatively, the wedge 90 could be flat. The wedge 90 may be secured to the pipe 80 by any well known means, such as welding, or alternatively may be integrally formed as part of the pipe 80. The wedge 90 has an upper end 90A and a lower end 90B with a gap 92 therebetween defining the opening in the "C-shape". A vertical flange 94 is positioned at the upper end 90A of the wedge 90 and extends longitudinally along pipe 80.

Figure 12:
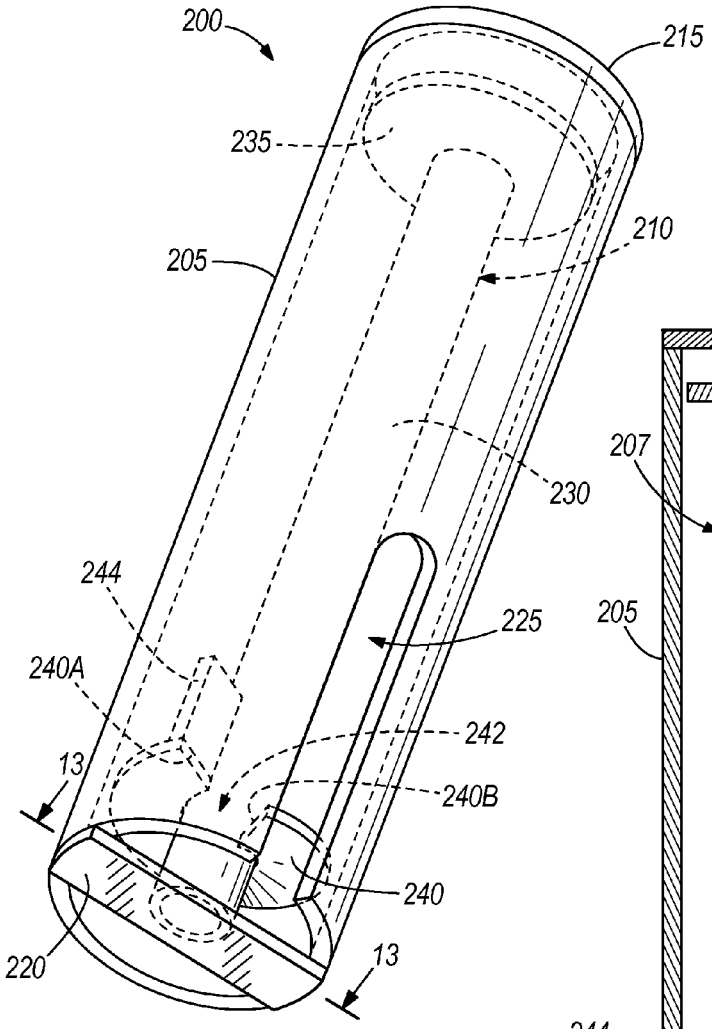
FIG. 12 is a perspective view of another example of a ground sleeve cap.

In operation, the ground sleeve 15 is first installed in the ground. Referring to FIG. 12, in one example a hole is dug in the ground 95 that is approximately 18 inches in diameter and 38 inches deep. The bottom of the hole is filled with approximately 3 inches of angular rock, gravel, or similar material to provide a drain base 96. A drain pipe 97, is placed in the center of the hole against the drain base 96 to provide drainage from the ground sleeve 15. In this example, the drain pipe 97 is a polyvinyl chloride (PVC) pipe that is 24 inches long and has an outer diameter that is approximately the same as the post 20. The ground sleeve 15 is placed over the drain pipe 97 until the drain pipe 97 contacts the stop bar 65 and the top of the ground sleeve 15 is level with the grade of the ground 95. If desired, rebar 98 can be placed around the drain pipe 97 and ground sleeve 15 to provide extra strength. The hole is then filled with concrete 99, such that the top of the concrete is level with the grade of the ground 95, to secure the ground sleeve 15. As mentioned above, the portion of the latch pin 55 that extends outside the ground sleeve wall will be secured in the concrete 99 and will prevent the ground sleeve 15 from rotating or moving vertically within the concrete 99.

The post 20 and insert 25 are assembled by placing the insert 25 into the cavity 45 of the post 20. The insert 25 travels into the cavity 45 until the end of pipe 80 opposite the end plate 85 contacts the stop plate 40 of the post 20. The insert 25 is positioned within the cavity 45 such that the wedge 90 and end plate 85 fit snuggly leaving a small gap between the wedge 90 and the inner surface of the post wall 30, and between the end plate 85 and the inner surface of the post wall 30, allowing the insert 25 to stand generally vertically within the post 20 and be rotated within the post 20. Once the insert 25 has been properly positioned within the cavity 45 of the post 20, the end cap 35 is positioned over the end of the wall 30 opposite the stop plate 40 and secured into place. The end cap 35 is secured to the wall 30 by any well known means, such as welding. Alternatively, the end cap 35 can be integrally formed as part of the wall 30, and the insert 25 is inserted into the post 20 at the opposite end of the post, and the stop plate 40 is secured in place by any suitable means, such as welding.

Once the ground sleeve 15 is installed in the ground 95 and the post 20 and insert 25 have been assembled, the post 20 and insert 25 can be inserted into the cavity 70 of the ground sleeve 15. To insert the post 20 and insert 25 into the ground sleeve 15, the post 20 and insert 25 are positioned above the ground sleeve 15, the insert 25 being positioned within the cavity 45 of the post 20 such that the gap 92 of wedge 90 is generally aligned with the passage 50 of the post 20 and the latch pin 55. The post 20 and insert 25 are then inserted into the ground sleeve 15 and pushed down so that the latch pin 55 travels along the passage 50 and through the gap 92 until the bottom of the post 20 or the stop plate 40 contacts the stop bar 65.

Referring to FIGS. 8 and 9, once the post 20 and insert 25 are fully inserted into the ground sleeve 15, referred to herein as the unlocked position (see FIG. 8), the insert 25 is rotated such that the lower end 90B of wedge 90 passes below the portion of the latch pin 55 that extends into the cavity 70 of ground sleeve 15. Insert 25 is rotated by means of a T-handle Allen wrench or the like (not shown), inserted through hole 37 in cap 35, which engages the hole 87 in the end plate 85 of the insert 25. The position of the insert 25 shown in FIG. 9 is referred to herein as the locked position. In the locked position, a portion of the wedge 90 is positioned below the latch pin 55, and the stop plate 40 of the post 20 is positioned below the lower end of the pipe 80 of insert 25, thereby preventing the post 20 and insert 25 from being separated or removed from the ground sleeve 15 by simply pulling on or twisting the post 20. Furthermore, as movement of the insert 25 in a downward direction is prevented by the stop plate 40 of the post 20, the insert 25 may be rotated such that the helical nature of the wedge 90 causes the wedge 90 to frictionally engage the latch pin 55 thereby stabilizing the insert 25 and post 20 and further fastening the insert 25 in the locked position. The vertical flange 94 of wedge 90 prevents the insert 25 from being rotated so far as to inadvertently re-align the gap 92 and passage 50, and also provides a stop when rotating the insert 25 from the locked position to the unlocked position so that a user knows the latch pin 55 is aligned with the gap 92 when the latch pin 55 hits the flange 94. To remove the post 20 and insert 25 the insert 25 must be rotated in the opposite direction of the rotation described above that locks the post 20 and insert 25, which then re-aligns the gap 92 and passage 50 at which point the post 20 may be pulled up to remove it from the ground sleeve 15. This rotation of the insert 25 from the locked position (FIG. 9) to the unlocked position (FIG. 8) prevents the post 20 from being removed by unauthorized persons. Generally, if someone unfamiliar with the post 20 were to try and remove it, they would do so by pulling up on the post 20. If this were to occur, the stop plate 40 would engage the pipe 80 of insert 25 causing the wedge 90 to engage the latch pin 55 and prevent further upward movement of the post 20 and insert 25. Unless the person was familiar with the post 20 and insert 25, they would not know that the post 20 and insert 25 can only be removed by rotating the insert 25 within the post 20 and would think that the post 20 was permanent.

Figure 11:
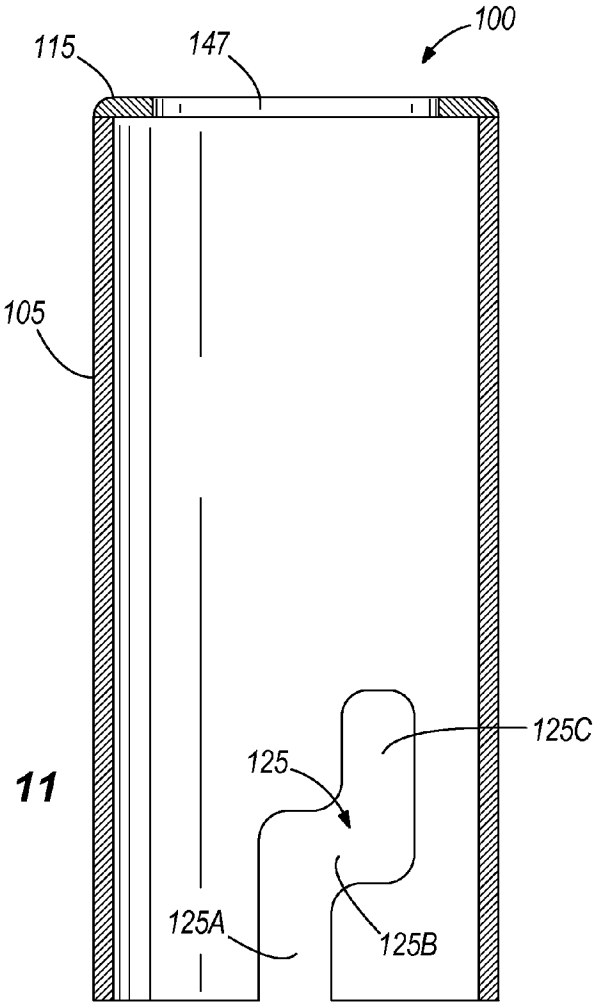
FIG. 11 is a cross-sectional view of the ground sleeve cap of FIG. 10 taken across line 11-11 in FIG. 10.
Figure 10:
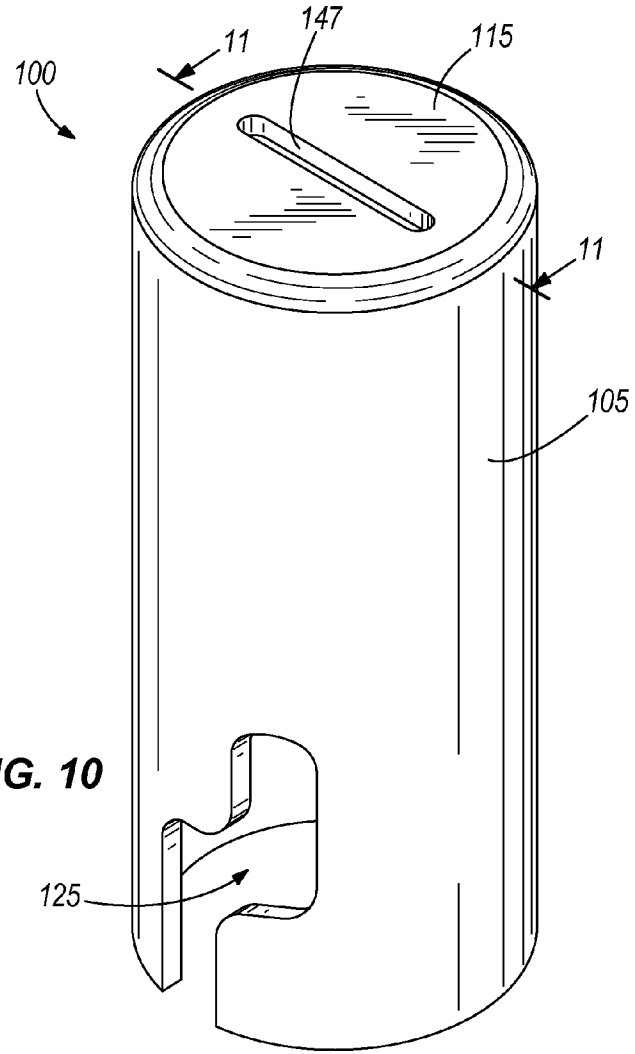
FIG. 10 is a perspective view of one example of a ground sleeve cap.

In another example, the bollard assembly 10 may also include a ground sleeve cover 100 that would be used to cover the ground sleeve 15 when the post 20 and insert 25 are not installed. Referring to FIGS. 10 and 11, an exemplary ground sleeve cover 100 has a generally cylindrical wall 105 and an end cap 115. A passage 125 is formed in the wall 105 and is adapted to receive the latch pin 55 in the ground sleeve 15. The passage 125 has three sections. The first section 125A begins at one end of the wall 105 and extends longitudinally along the wall 105. The second section 125B begins at the end of the first section and extends in this example transverse to the first section 125A. The third section 125C begins at the end of the second section 125B and also extends longitudinally along the wall 105. The stair-step type configuration of the various sections of the passage 125 prevents the ground sleeve cover 100 from being removed from the ground sleeve 15 with a simple straight pulling motion, which gives the appearance that the ground sleeve cover 100 cannot be removed.

Alternatively, the passage 125 can also be formed by two sections, the first section 125A and the second section 125B as described above. This configuration will also prevent the ground sleeve cover 100 from being removed from the ground sleeve 15 with a simple straight pulling motion, giving the appearance that the ground sleeve cover 100 cannot be removed. In one example, the ground sleeve cover wall 105 is hot dipped galvanized steel. However, the cover wall 105 can be made of other appropriate material, such as carbon steel, stainless steel, or HDPE as desired for any particular application. In addition, like the post 20, the ground sleeve cover wall 105 can have an outer diameter of 3.5, 4.5, or 6.625 inches, or any other outer diameter that is appropriate for a particular application and compatible with a corresponding ground sleeve.

The end cap 115 covers the end of the wall 105 opposite the passage 125. The end cap 115 is placed flush with the end of the wall 105 and the end cap 115 is butt welded to the wall 105 or secured to the wall by some other well known means. Alternatively, the end cap 115 can also be integrally formed as part of the wall 105. A slot 147 is formed in the end cap 115 and is adapted to receive a key or other tool to assist in inserting and removing the ground sleeve cover 100. The end cap 115 is a typically manufactured of the same material as the cover wall 105 and in this particular example is 0.25 inches thick and has roughly the same outer diameter as the wall 105. The slot 147 extends across the end cap 115 and is 0.25 inches wide and 2.25 inches long.

To install the ground sleeve cover 100, the ground sleeve cover 100 is positioned above the ground sleeve 15 such that the first section 125A of the passage 125 is aligned with the latch pin 55. The ground sleeve cover 100 is then inserted into the ground sleeve 15 and pushed down so that the latch pin 55 travels along the first section 125A. Once the latch pin 55 reaches the end of the first section 125A, the ground sleeve cover 100 is rotated so that the latch pin 55 travels along the second section 125B. Once the latch pin 55 reaches the end of the second section 125B, the ground sleeve cover 100 is then pushed down again so that the latch pin 55 travels along the third section 125C. The ground sleeve cover 100 is pushed down until the latch pin 55 contacts the end of the third section 125C or the bottom of the ground sleeve cover 100 contacts the stop bar 65, depending on the exact dimension and the installation of the ground sleeve 15.

To remove the ground sleeve cover 100, a key or other tools is inserted into the slot 147 and the ground sleeve cover 100 is lifted so that the latch pin 55 travels along the third section 125C. The ground sleeve cover 100 is then rotated so that the latch pin 55 travels along the second section 125B and lifted again so that the latch pin 55 travels along the first section 125A and the ground sleeve cover 100 can be removed from the ground sleeve 15.

Figure 13:
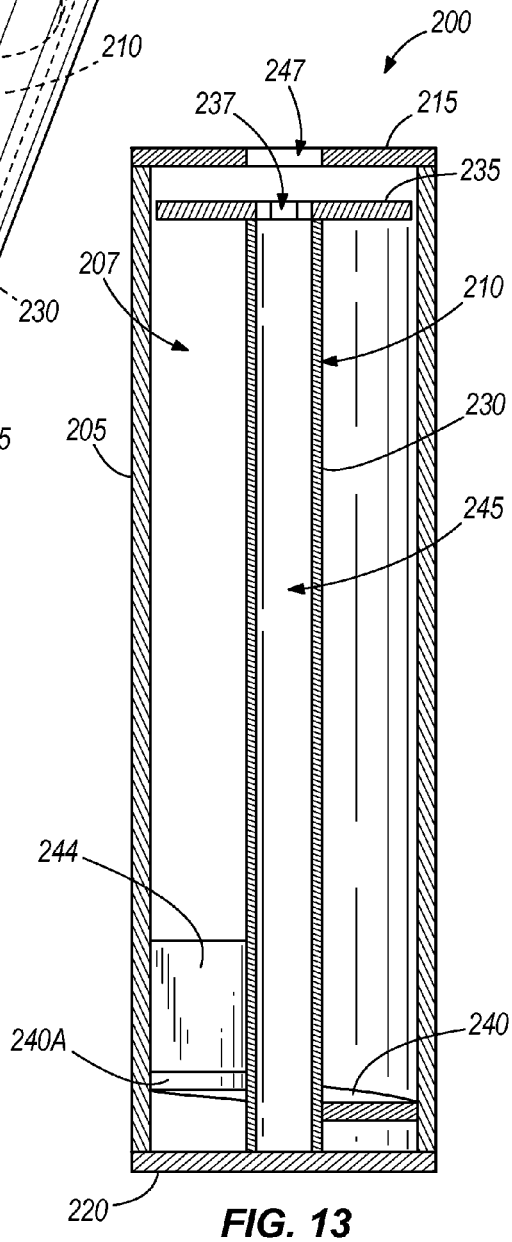
FIG. 13 is a cross-sectional view of the ground sleeve cap of FIG. 12 taken across line 13-13 in FIG. 12.
Figure 14:
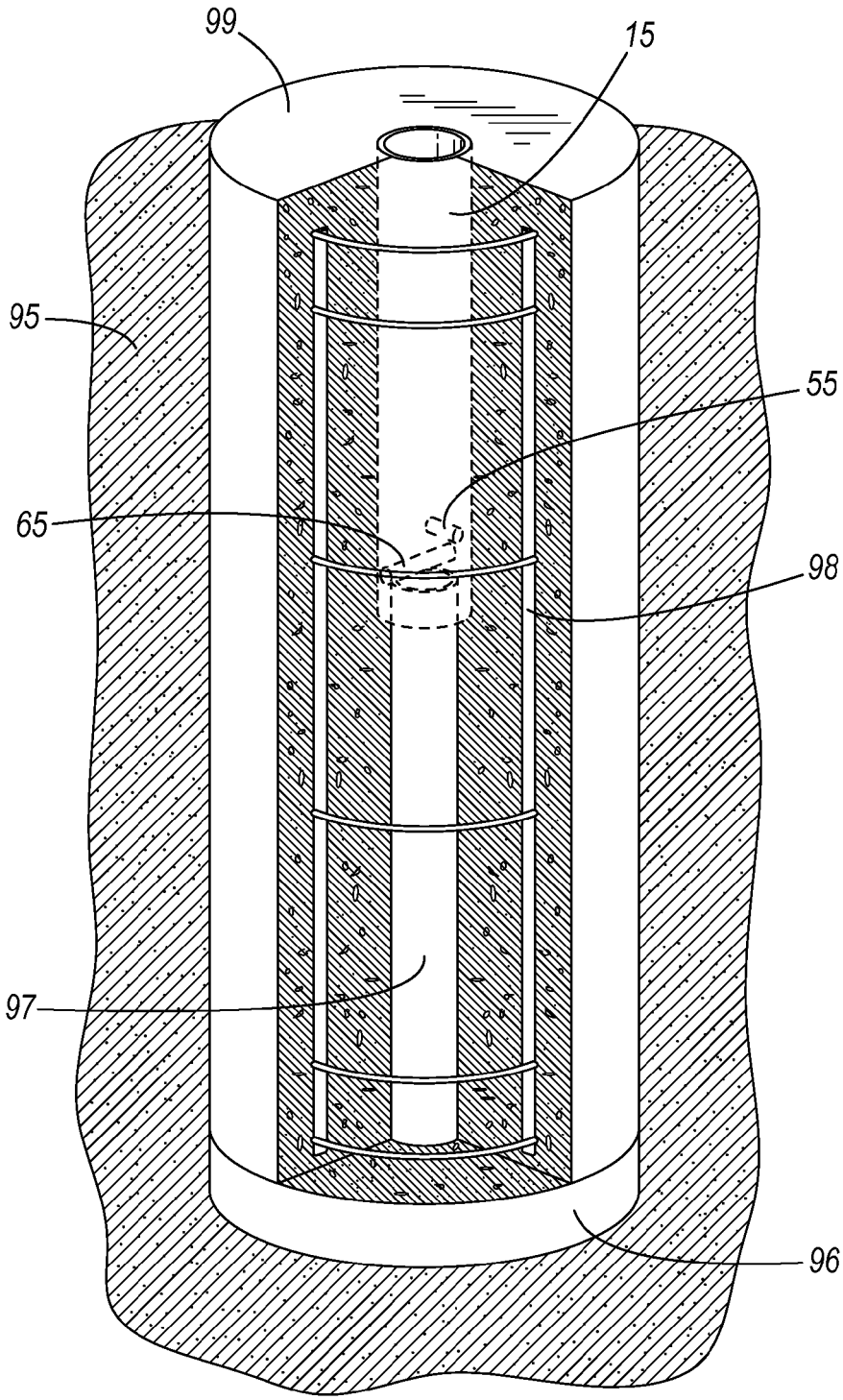
FIG. 14 is a cutaway perspective view of one example of an installation of the ground sleeve of the bollard assembly.

Referring to FIGS. 12 and 13, another example of a ground sleeve cover 200 has a generally cylindrical wall 205, a cover insert 210, an end cap 215 and a stop plate 220. Just like post 20, the wall 205 forms cavity 207 and is dimensioned to receive the cover insert 210 into the cavity 207. A passage 225 is formed in the wall 205, which is identical to the passage 50 in the post wall 30, and is adapted to receive the latch pin 55 in the ground sleeve 15. The passage 225 begins at one end of the wall 205 and extends longitudinally along the wall 205. In other examples, the passage 225 may have a different configuration such as, for example, multiple intersecting sections that are configured non-linearly with respect to each other. In one example, the ground sleeve cover wall 205 is hot dipped galvanized steel. However, the cover wall 205 can be made of other appropriate material, such as carbon steel, stainless steel, or HDPE as desired for any particular application. In addition, like post 20, the ground sleeve cover wall 205 can have an outer diameter of 3.5, 4.5, or 6.625 inches, or any other outer diameter that is appropriate for a particular application and compatible with a corresponding ground sleeve.

The cover insert 210 is almost identical in construction to the insert 25, but for the overall length being shorter. The cover insert 210 includes a pipe 230, an end plate 235 and a wedge 240. The pipe 230 is generally cylindrical and hollow forming a cavity 245 through the length of the pipe 230 such that liquids can travel in one end of the pipe 230 through the cavity 245 and out the other end of the pipe 230.

The end plate 235 is a generally circular plate secured to one end of the pipe 230, and has an outer diameter that is less than the inner diameter of the wall 205 of the ground sleeve cover 200 such that the pipe 230 and end plate 235 fit snuggly within the cavity 207 of the ground sleeve cover 200. The end plate 235 may be secured to the pipe 230 by any well known means, such as welding, or the end plate 235 can be integrally formed as part of the pipe 230. The end plate 235 includes a hole 237 through its center that is dimensioned to engage a tool allowing the cover insert 210 to be rotated via the tool. In the example shown, hole 237 is a hexagon shaped and dimensioned to engage a T-handle Allen Wrench.

The wedge 240 has a split C-shape and is positioned helically around the outer surface of the pipe 230 a certain distance from the end of the pipe opposite the end plate 235. Alternatively, the wedge 240 could be flat. The wedge 240 may be secured to the pipe 230 by any well known means, such as welding, or alternatively may be integrally formed as part of the pipe 230. The wedge has an upper end 240A and a lower end 240B with a gap 242 therebetween defining the opening in the "C-shape". A vertical flange 244 is positioned at the upper end 240A of the wedge 240 and extends longitudinally along pipe 230.

The end cap 215 covers the end of the wall 205 opposite the passage 225. The end cap 215 is a generally circular plate with flat top and bottom surfaces that has roughly the same outer diameter as the wall 205, as seen in FIG. 13. The end cap 215 includes a hole 247 through its center that is dimensioned to allow a tool, such as a T-handle Allen Wrench, to pass therethrough and engage the hole 237 of the cover insert 210 within the cavity 207 in the same fashion as the insert 25 discussed above. The end cap 215 is secured to the wall 205 by any well known means, such as welding. Alternatively, the end cap 215 can be integrally formed as part of the wall 205. The end cap 215 is typically manufactured of the same material as the cover wall 205 and in this particular example is 0.25 inches thick and has roughly the same outer diameter as the wall 205.

The stop plate 220 is positioned at the base of the wall 205, and extends across cavity 207 such that the ends of the stop plate 220 are generally flush with the outer surface of the wall 205 and is welded in place. The stop plate 220 will prevent the cover insert 210 from traveling too far into the cover 200 as well as prevent the cover 200 from being removed from the ground sleeve 15 once the cover insert 210 is locked into place. As with the post 20 and insert 25, rotating the cover insert 210 into a locked position prevents the ground sleeve cover 200 from being removed from the ground sleeve 15 with a simple straight pulling motion, which gives the appearance that the ground sleeve cover 200 cannot be removed.

To install the ground sleeve cover 200, the ground sleeve cover 200 and cover insert 210 are positioned above the ground sleeve 15, the cover insert 210 being positioned within the cavity 207 of the cover 200 such that the gap 242 of wedge 240 is generally aligned with the passage 225 of the cover 200 and the latch pin 55. The ground sleeve cover 200 and cover insert 210 are then inserted into the ground sleeve 15 and pushed down so that the latch pin 55 travels along the passage 225 and through the gap 242. The cover 200 and cover insert 210 are pushed down until the bottom of the wall 205 or the stop plate 220 contacts the stop bar 65.

Just as with the post 20 and insert 25, once the cover 200 and cover insert 210 are fully inserted into the ground sleeve 15, the unlocked position, the cover insert 210 is rotated into a locked position such that the lower end 240B of wedge 240 passes below the portion of the latch pin 55 that extends into the cavity 70 of ground sleeve 15. Cover insert 210 is rotated by means of a T-handle Allen wrench or the like (not shown), inserted through hole 247 in end cap 215, which engages the hole 237 in the end plate 235 of the cover insert 210. In the locked position, a portion of the wedge 240 is positioned below the latch pin 55, and the stop plate 220 of the cover 200 is positioned below the lower end of the pipe 230 of cover insert 210, thereby preventing the cover 200 and cover insert 210 from being separated or removed from the ground sleeve 15 by simply pulling on or twisting the cover 200. Furthermore, as movement of the cover insert 210 in a downward direction is prevented by the stop plate 220 of the cover 200, the cover insert 210 may be rotated such that the helical nature of the wedge 240 causes the wedge 240 to frictionally engage the latch pin 55 thereby stabilizing the cover insert 210 and cover 200 and further fastening the cover insert 210 in the locked position. The vertical flange 244 of wedge 240 prevents the cover insert 210 from being rotated so far as to inadvertently re-align the gap 242 and passage 225, and also provides a stop when rotating the cover insert 210 from the locked position to the unlocked position so that a user knows the latch pin 55 is aligned with the gap 242 when the latch pin 55 hits the flange 244. To remove the cover 200 and cover insert 210 the cover insert 210 must be rotated in the opposite direction to re-align the gap 242 and passage 225 at which point the cover 200 may be pulled up to remove it from the ground sleeve 15.

The foregoing description of the preferred embodiment of the invention has been presented for purposes of illustration and description, and is not intended to be exhaustive or to limit the invention to the precise form disclosed. The descriptions were selected to best explain the principles of the invention and their practical application to enable other skills in the art to best utilize the invention in various embodiments and various modifications as are suited to the particular use contemplated. It is intended that the scope of the invention not be limited by the specification, but be defined by the claims set forth below.

What is claimed is:

1. A bollard assembly, comprising:

a post comprising a generally cylindrical post wall forming a cavity, the post wall having a passage extending generally longitudinally along the post wall, and a stop plate secured to one end of the post wall and extending across the cavity;

an insert positioned within the cavity of the post, the insert comprising a pipe, a generally penannular wedge extending radially outward from the pipe and defining a gap therein; and a sleeve comprising a generally cylindrical sleeve wall forming a cavity and a latch pin attached to the sleeve wall and extending into the cavity of the sleeve;

wherein the sleeve is adapted to receive the post such that the latch pin travels through the passage in the post wall and the gap in the wedge of the insert when the passage in the post wall and the gap in the wedge of the insert are aligned, and the insert is rotatable within the cavity of the post such that rotation of the insert will misalign the gap of the wedge with the passage in the post wall such that the wedge prevents the latch pin from traveling through the passage.

2. A bollard assembly, as recited in claim 1, wherein the wedge includes a flange extending generally longitudinally along the pipe.

3. A bollard assembly, as recited in claim 2, wherein the flange is adjacent the gap in the wedge.

4. A bollard assembly, as recited in claim 1, wherein a first end of the wedge is axially displaced from a second end of the wedge such that the wedge is generally helical about the pipe.

5. A bollard assembly, as recited in claim 1, wherein the latch pin also extends through the sleeve wall and protrudes beyond an outside surface of the sleeve wall.

6. A bollard assembly, as recited in claim 1, wherein the sleeve further comprises a stop bar attached to the sleeve wall below the latch pin and extending into the cavity formed by the sleeve wall.

7. A bollard assembly, as recited in claim 1, wherein the post further comprises an end cap secured to the post wall to cover an end of the post, the end cap having an aperture therein.

8. A bollard assembly, as recited in claim 1, wherein the insert further comprises a generally circular plate secured to a first end of the pipe, opposite the wedge, the plate extending radially outward from the pipe and being sized to fit within the cavity of the post.

9. A bollard assembly, as recited in claim 8, wherein the plate includes a hole adapted to receive a tool for rotating the insert.

10. A bollard assembly kit comprising:

a post comprising a generally cylindrical post wall forming a cavity, the post wall having a passage extending generally longitudinally along the post wall, and a stop plate secured to one end of the post wall and extending across the cavity of the post;

an insert positioned within the cavity of the post, the insert comprising a pipe, a generally penannular wedge extending radially outward from the pipe, and defining a gap therein;

a sleeve comprising a generally cylindrical sleeve wall forming a cavity and a latch pin attached to the sleeve wall and extending into the cavity of the sleeve;

a cover comprising a generally cylindrical cover wall forming a cavity, the cover wall having a passage therein, a cover plate secured to one end of the cover wall and extending across the cavity of the cover, and a cover cap secured to the end of the cover wall opposite the cover plate;

wherein the sleeve is adapted to receive the post such that the latch pin travels through the passage in the post wall and the gap in the wedge of the insert when the passage in the post wall and the gap in the wedge of the insert are aligned, and wherein the insert is rotatable within the cavity of the post such that rotation of the insert will misalign the gap of the wedge with the passage in the post wall such that the wedge prevents the latch pin from traveling through the passage; and wherein the sleeve is adapted to receive the cover such that the latch pin travels through the passage in the cover wall.

11. A bollard assembly kit, as recited in claim 10, wherein the passage in the cover wall comprises a first section extending generally longitudinally along the cover wall and a second section intersecting the first section and extending generally crosswise to the first section.

12. A bollard assembly kit, as recited in claim 11, wherein the passage in the cover wall further comprises a third section intersecting the second section and extending generally longitudinally along the cover wall.

13. A bollard assembly kit, as recited in claim 10, wherein the cover further comprises a cover insert positioned within the cavity of the cover, the cover insert comprising a pipe, a generally penannular wedge extending radially outward from the pipe of the cover insert and defining a gap therein; and wherein the sleeve is further adapted to receive the cover such that the latch pin travels through the gap in the wedge of the cover insert when the passage in the cover wall and the gap in the wedge of the cover insert are aligned, and wherein the cover insert is rotatable within the cavity of the cover such that rotation of the cover insert will misalign the gap of the wedge of the cover insert with the passage in the cover wall such that the wedge of the cover insert prevents the latch pin from traveling through the passage in the cover wall.

14. A bollard assembly kit, as recited in claim 13, wherein the wedge of the cover insert includes a flange extending generally longitudinally along the pipe of the cover insert.

15. A bollard assembly kit, as recited in claim 14, wherein the flange of the wedge of the cover insert is adjacent the gap in the wedge of the cover insert.

16. A bollard assembly kit, as recited in claim 13, wherein a first end of the wedge of the cover insert is axially displaced from a second end of the wedge of the cover insert such that the wedge of the cover insert is generally helical about the pipe of the cover insert.

17. A bollard assembly kit, as recited in claim 13, wherein the cover insert further comprises a generally circular plate secured to a first end of the pipe of the cover insert, opposite the wedge of the cover insert, the plate of the cover insert extending radially outward from the pipe of the cover insert and being sized to fit within the cavity of the cover.

18. A bollard assembly kit, as recited in claim 17, wherein the plate of the cover insert includes a hole adapted to receive a tool for rotating the cover insert.

* * * * *